US007916099B2

(12) United States Patent
Steer et al.

(10) Patent No.: US 7,916,099 B2
(45) Date of Patent: Mar. 29, 2011

(54) ELECTROLUMINESCENT DISPLAY DEVICE WITH SCROLLING ADDRESSING

(75) Inventors: William A. Steer, Stanmore (GB); David A. Fish, Haywards Heath (GB); Franciscus P. M. Budzelaar, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 893 days.

(21) Appl. No.: 10/574,445

(22) PCT Filed: Oct. 5, 2004

(86) PCT No.: PCT/IB2004/051971

§ 371 (c)(1), (2), (4) Date: Apr. 6, 2007

(87) PCT Pub. No.: WO2005/036515

PCT Pub. Date: Apr. 21, 2005

(65) Prior Publication Data

US 2007/0262928 A1 Nov. 15, 2007

(30) Foreign Application Priority Data

Oct. 9, 2003 (GB) ..... 0323622.1

(51) Int. Cl.
*G09G 3/32* (2006.01)

(52) U.S. Cl. ..... 345/76; 345/77

(58) Field of Classification Search ..... 345/76, 345/77, 205, 210, 211; 702/189; 257/59
See application file for complete search history.

(56) References Cited

U.S. PATENT DOCUMENTS

| | | | | |
|---|---|---|---|---|
| 5,532,763 | A | 7/1996 | Janssen et al. | |
| 6,448,951 | B1 | 9/2002 | Sakaguchi et al. | |
| 6,509,690 | B2 | 1/2003 | Sempel et al. | |
| 6,583,775 | B1 * | 6/2003 | Sekiya et al. | 345/76 |
| 2002/0135312 | A1 | 9/2002 | Koyama | |
| 2003/0025665 | A1 | 2/2003 | Janssen et al. | |
| 2003/0117352 | A1 | 6/2003 | Kimura | |

FOREIGN PATENT DOCUMENTS

| | | | |
|---|---|---|---|
| CN | 1278635 | A | 1/2003 |
| EP | 0574810 | A1 | 12/1993 |
| EP | 0370258 | A1 | 4/1996 |
| EP | 0708553 | A2 | 4/1996 |
| EP | 1130565 | A1 | 5/2001 |
| JP | 08202310 | | 8/1996 |
| JP | 09190162 | | 7/1997 |

OTHER PUBLICATIONS

Akira Yumoto et al, "Pixel-Driving Method for Large-Sized Poly-Si AM-OLED Displays", Asia Display/IDW 2001, p. 1395-1398.

* cited by examiner

*Primary Examiner* — Quan-Zhen Wang
*Assistant Examiner* — Yuk Chow

(57) ABSTRACT

An active matrix electroluminescent display has means for interrupting the drive of current through the display element. Row driver circuitry for the display has a shift register and logic arrangement (50, 54) for generating the drive voltage for the interrupting means, and which includes a pulse having a duration which can be varied up to substantially the full field period less the address period. The signal or signals propagated through the shift register arrangement (50) control the pulse duration. This arrangement provides reduced driver complexity to allow control for the row by row addressing of the pixels with control of the overall light emission period of each row. The control enables a scrolling addressing scheme to be implemented.

17 Claims, 6 Drawing Sheets

ELECTROLUMINESCENT DISPLAY DEVICE WITH SCROLLING ADDRESSING

This invention relates to electroluminescent display devices, particularly active matrix display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

FIG. 1 shows a known pixel circuit for an active matrix addressed electroluminescent display device. The display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support.

LED displays (both polymer-type and small-molecule) provide a number of well-known benefits over existing commercialised flat-panel screen technologies such as LCD. These advantages include better viewing angle, faster intrinsic response time (better motion-picture performance), lighter-weight, lower power consumption and cheaper production costs.

Passive matrix displays illuminate one row of pixels at a time, with resulting very high peak brightness, and large voltage swings. Power losses increase exponentially with display diagonal, and such displays become impractical with existing materials beyond around 8 cm diagonal. Active matrix technology places a memory element in each pixel, enabling rows of pixels to be addressed with a data voltage which programs the pixel current flow for the whole frame period.

A display in which all the pixels emit light continuously (such as the simple active matrix scheme described above), leads to a problem which is sometimes overlooked. If an observer watches a moving image on the screen, owing to their eye tracking the motion and integrating the light received, a type of motion blur results. It is known that reducing the display duty cycle (e.g. to 25%) greatly reduces this form of image impairment.

One demonstrated means of achieving this duty cycle reduction in an LCD is to strobe the whole backlight. A comparable technique could be applied to active matrix OLED displays; first the field luminance data is programmed, then the whole display is "flashed" (either by switching the common cathode, the power rail, or some in-pixel transistors), before the next field is programmed.

The resulting moving images are much sharper. Flashing may introduce field flicker as side effect, but this can be suppressed by making the flash frequency high enough. In an LCD, the switching on and off of the image is performed by the backlight. The LCD itself is not fast enough for this.

New LED displays, do not exhibit this slow response, and the light switching can thus be performed by the pixel cells themselves, allowing a very flexible control of the way the image is created at a very low cost. Pixels can be programmed to generate a specific amount of light, and can be programmed again to switch off, thus creating a scheme in which light is generated with a certain duty cycle.

A known addressing scheme is the 'address & flash' scheme where the field time is divided in two periods: an address period in which every line is programmed with the image information, but no light is generated; and a period in which no addressing takes place, and the display is generating light.

In an active-matrix OLED-type display there are two principal disadvantages of "flashing" the whole screen in this way: the time available for addressing the display is reduced to the frame-rate less the "flash" period (and, particularly in high resolution displays, as much time as possible is needed for the addressing), and also, due to leakage, the brightness or contrast characteristics of the image in the most recently-addressed part of the display (typically the bottom) are likely to differ from that part first addressed (e.g. the top).

A "scrolling" method of illumination has also been proposed, whereby lines are addressed sequentially in a conventional way, then are illuminated for n line-times (the line-time being the time to address one row of pixels) after addressing. In this way, the portion of the screen illuminated at any instant in time is perhaps one quarter (25% duty cycle) of the screen, immediately trailing the line being addressed. This method ensures that every line is illuminated for the same time after addressing.

U.S. Pat. No. 6,583,775 discloses a drive scheme in which rows are addressed in turn, but they are turned off before the end of the field period, to provide brightness control in the manner described above.

FIG. 2 shows these different known drive schemes. The scrolling technique shown has been demonstrated on LCDs with segmented, and sequentially illuminated, backlights.

The implementation of a scrolling technique complicates the drive scheme. In particular, it requires each row to be addressed for only a fraction of the field period, so that there is a period of non-illumination. As the rows are addressed in sequence, this period of non-illumination then "scrolls" down the display. This invention relates to a driver architecture design to facilitate application of the scrolling illuminated region technique to LED displays.

According to the invention, there is provided an active matrix electroluminescent display device comprising an array of display pixels arranged in rows and columns, each pixel comprising:

an electroluminescent (EL) display element;

a drive transistor for driving a current through the display element;

means for interrupting the drive of current through the display element; and row driver circuitry for generating control voltages to be applied to the pixels in each row in sequence including a drive voltage for the interrupting means, wherein the row driver circuitry comprises a shift register arrangement and logic arrangement for generating the drive voltage for the interrupting means, the drive voltage for the interrupting means including a pulse having a duration which can be varied up to substantially the full field period less the address period, wherein the signal or signals propagated through the shift register arrangement control the pulse duration.

This arrangement provides reduced driver complexity to allow control for the row by row addressing of the pixels with control of the overall light emission period of each row.

In one arrangement, the shift register and logic arrangement comprises first and second shift register devices, each having a pulse propagating through them, and logic means for deriving a signal having a pulse with duration derived from the difference in timing of the pulses propagating through the first and second shift registers.

The signal with the pulse of variable duration is then used to derive the control signal for the interrupting means. The timing of one pulse in a shift register device can then be used to control the illumination time.

The pulse propagating in each shift register device may have a duration corresponding the line time (i.e. row address time) of the display. Thus, two identical pulses pass through two shift register devices at different times.

The logic means may then comprise a transmission gate which transmits a low pulse in response to a pulse on one of the shift register devices and transmits a high pulse in response to a pulse on the other one of the shift register devices. In this way, one of the shift register device pulses can be used for timing the variable duration pulse start and the other shift register device pulse can be used for timing the variable duration pulse end. The logic means may further comprises a memory cell for maintaining a constant output between pulses received from the transmission gate.

In another arrangement, the shift register and logic arrangement comprises first and second shift register devices, each having a pulse propagating through them, and logic means for deriving a signal having a pulse with duration derived from the duration of the pulse in one of the first and second shift register devices.

In this arrangement, one of the pulses is used for normal addressing, and the other has a duration to determine the illumination time. Thus, the pulse propagating in one shift register device can have a duration corresponding to the line time of the display and the pulse propagating in the other shift register device can have a duration for controlling the display element illumination period.

In a further arrangement, the shift register and logic arrangement comprises a shift register device, having a pulse propagating through it having a duration dependent on the desired illumination time of the display element, and logic means for deriving from the shift register device a pulse having a duration corresponding to the line time of the display.

This arrangement uses a single shift register devices, and two control pulses can be derived from the overlap of the pulse in different shift register elements. The logic means for deriving from the shift register device a pulse having a duration corresponding to the line time of the display thus comprises a combination element for combining the pulse at the output of one shift register element for one row with the pulse at the output of another shift register element for an adjacent row.

In all embodiments, a first pulse from the shift register and logic arrangement is combined with a first template control signal or signals to provide a first control signal or signals for the addressing of the pixel, and a second pulse from the shift register and logic arrangement is combined with a second template control signal to provide the drive voltage for the interrupting means both during the addressing of the pixel and during subsequent driving of the pixel. The circuit thus provides the row control voltages for the addressing of the pixels, but also provides a control voltage for the interrupting means during the pixel driving period.

The first pulse has duration equal to the line time and the second pulse has duration selected to control the display element illumination time.

Each pixel preferably comprises drive transistor threshold compensation circuitry, for example first and second capacitors connected in series between the gate and source of the drive transistor, a data input to the pixel being provided to the junction between the first and second capacitors thereby to charge the first capacitor to a voltage derived from the pixel data voltage, and a voltage derived from the drive transistor threshold voltage being stored on the second capacitor.

Although the row driver complements this type of threshold voltage compensation pixel circuit known, the architecture is equally applicable to other pixel designs.

The invention also provides a method of driving an active matrix electroluminescent display device comprising an array of display pixels arranged in rows and columns, in which each pixel comprises an electroluminescent (EL) display element, a drive transistor for driving a current through the display element and means for interrupting the drive of current through the display element, the method comprising:

propagating a pulse or pulses through a shift register arrangement;

using a pulse from the shift register arrangement to allow pixel addressing control voltages to be applied to the pixels of a row during an addressing period;

using the shift register pulse or pulses to derive a drive voltage for the interrupting means including a pulse having a duration which can be varied up to substantially the full field period less the addressing period; and applying the drive voltage for the interrupting means to the interrupting means after the pixel addressing period.

Examples of the invention will now be described in detail with reference to the accompanying drawings, in which.

The invention relates to the addressing of an active matrix electroluminescent display device comprising an array of display pixels arranged in rows and columns, and to the row driver circuitry which generates the control voltages to be applied to the pixels in each row. In particular it relates to pixels having an interrupting means, so that the display element can be turned off. The row driver circuitry of the invention uses a shift register and logic arrangement for generating a drive voltage for the interrupting means having a pulse with a duration which can be varied and depends on the signal or signals propagated through the shift register arrangement.

Before describing the row driver architecture of the invention in detail, a basic known pixel design will be described, which compensates for threshold voltage drift in the drive transistor of the pixel.

Figure 1:
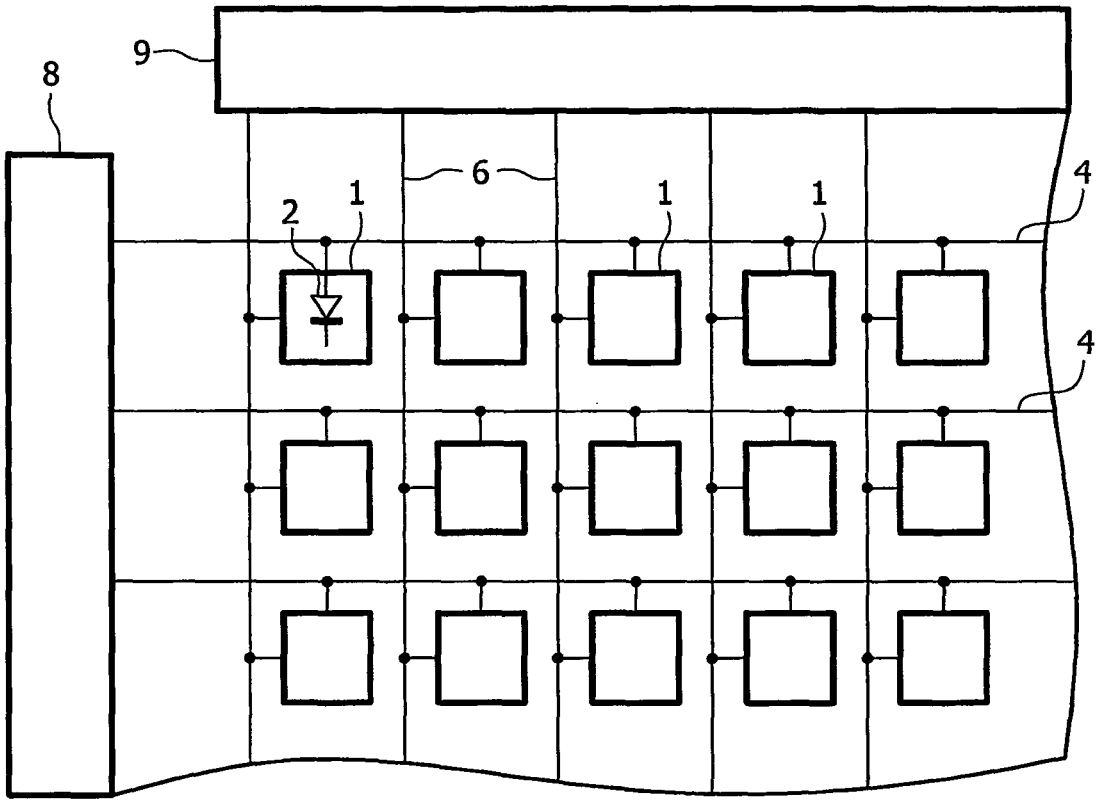
FIG. 1 PRIOR ART
FIG. 1 shows a conventional LED display.
Figure 2:
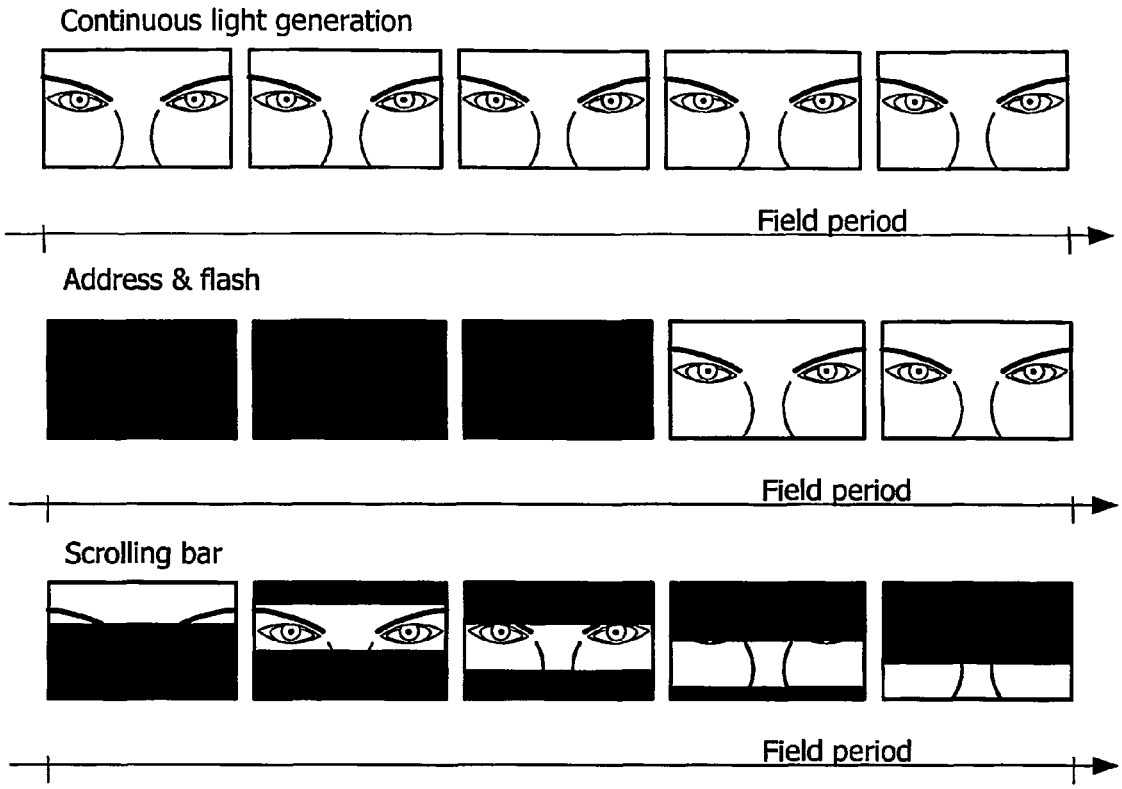
FIG. 2 shows a number of known addressing techniques.
Figure 3:
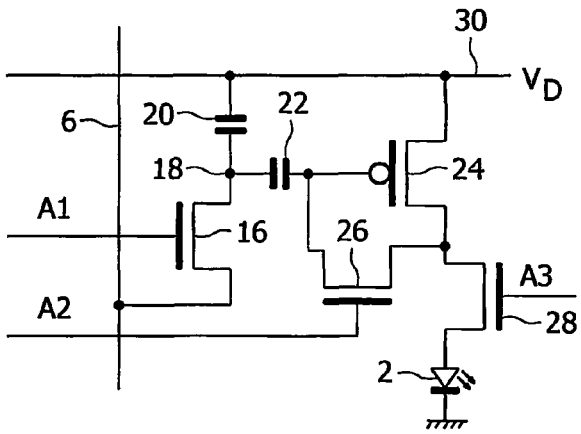
FIG. 3 shows a known LED pixel circuit, to which the invention may be applied.

FIG. 3 shows in simplified schematic form one example of known pixel and drive circuitry arrangement for providing voltage-programmed operation with threshold voltage compensation.

Each pixel 1 comprises the EL display element 2 and associated driver circuitry. The driver circuitry has an address transistor 16 which is turned on by a row address pulse on the row conductor A1. When the address transistor 16 is turned on, a voltage on the column conductor 6 can pass to the remainder of the pixel. In particular, the address transistor 16 supplies the column conductor voltage to an input node 18. This node 18 is at the junction of series-connected first and second capacitors 20, 22 which are connected between the gate and source of a drive transistor 24.

The drive transistor 24 and the capacitors 20,22 function as a current source. The drive transistor 24 draws a current from the power supply line 30, and the current drawn depends on the voltage across the series-connected capacitors.

In operation of the pixel, the data voltage is stored on the first capacitor 20 and the threshold voltage of the drive transistor 24 is stored on the second capacitor 22. This threshold voltage is measured each time the pixel is addressed. The gate-source voltage for the drive transistor thus compensates for threshold variations of the drive transistor.

To allow the threshold voltage measurement, the circuit has a shorting transistor 26 between the gate and drain of the drive transistor, controlled by line A2, and a transistor 28 for preventing light output from the display element, controlled by line A3. The transistor 28 this functions as an interrupt device.

Figure 4:
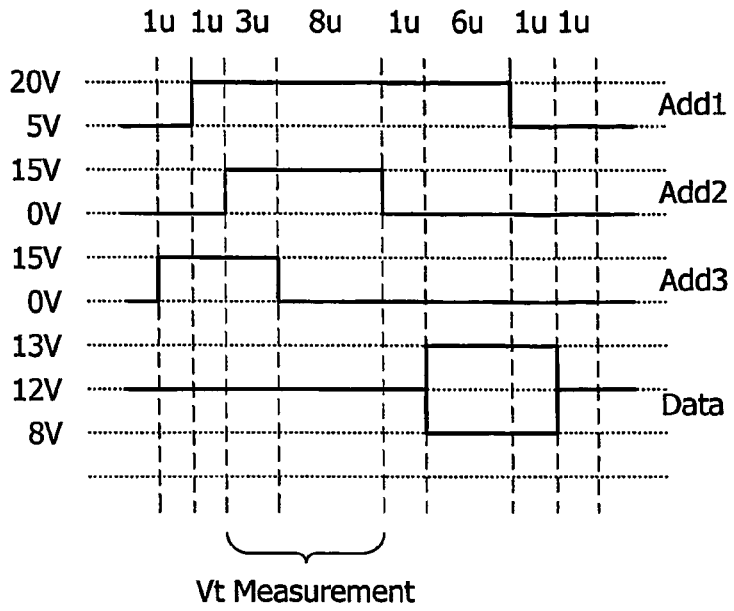
FIG. 4 shows the timing for the circuit of FIG. 3.

The operation of the circuit is described below. However, it should be noted that there are many variations to this circuit, for example to enable a smaller number of control lines to be required. For example, the power supply line 30 can be switched. FIG. 4 shows the timing of operation of the known pixel circuit of FIG. 3.

At the beginning of the pixel programming phase, the transistor 28 is turned on. The address transistor 16 is then turned on, and a default voltage on the column 6 (12V in the example shown) is sufficient so that the drive transistor 24 drives a current through the display element 2.

The shorting transistor 26 is turned on to connect the gate and drain of the drive transistor. The transistor 28 is then turned off to switch off the display element.

The drive transistor remains turned on, because of the gate-source voltage. However, the current drawn passes through the shorting transistor 26 and discharges the capacitor 22. At a certain point in time, the capacitor 22 is discharged to the point where the gate-source voltage is equal to the threshold voltage. The drive transistor 24 then switches off, and the voltage on the second capacitor 22 is related to the threshold voltage of the drive transistor. The capacitor 20 has a fixed voltage across it because the address transistor 16 is on for the full duration of the threshold voltage measurement operation.

The shorting transistor is then turned off, and data can be applied to the capacitor 20, through the address transistor 16 which is still turned on. The combined voltage across the capacitors 20 and 22 then compensates for the drive transistor threshold voltage.

After addressing, control line A3 is returned to high for emission to take place (not shown).

The invention provides a row driver architecture suitable for this type of pixel circuit for implementing a scrolling addressing scheme.

Figure 5:
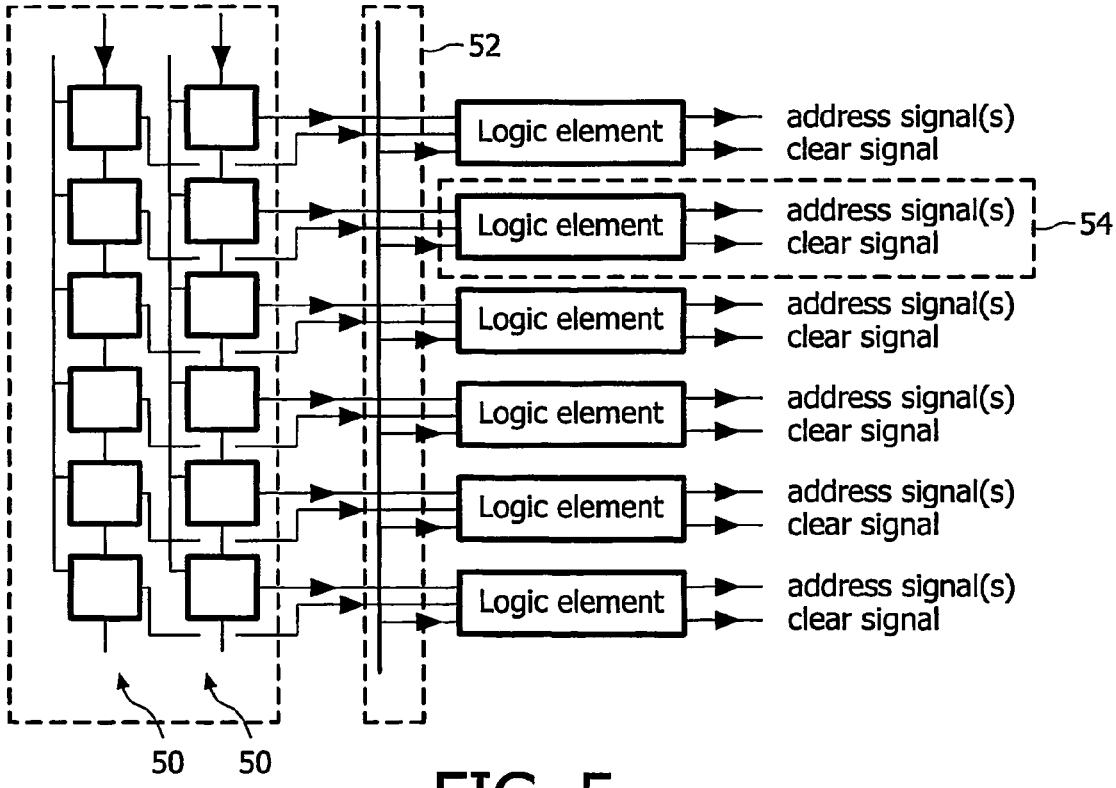
FIG. 5 shows a row driver architecture of the invention.

FIG. 5 shows a first example of row driver architecture of the invention.

The row driver has a number of shift register chains 50 for the application of control voltages in sequence to the rows of the display. Each control voltage pulse lasts for the duration of the line time, and is applied to the rows in sequence. These registers are thus clocked at the line rate.

An additional control bus line or lines 52 are provided as well as a logic element 54 for each row which alters the timing of the row address signals to provide the scrolling function. Each logic element provides a row address signal and a clear signal.

The circuit operates to control the transistor 28 in order to control the duration of the LED display output period.

Figure 6:
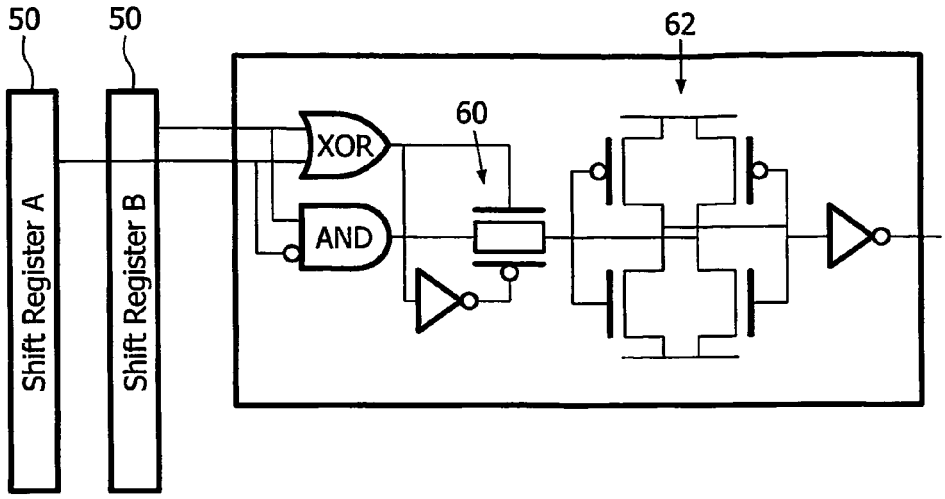
FIG. 6 shows a first implementation of the logic elements used in the circuit of FIG. 5.

In a first embodiment of FIG. 6, two shift registers A and B in the row driver are used. A single pulse is propagated shift register A, which selects the row to be addressed, while a second single-pulse is propagated down the second shift register, B. The time difference between them is used to generate the long emission-time pulse, which controls the output of the display element.

In FIG. 6, a pulse in either shift register 50 activates a transmission gate 60. If the pulse was in A the gate will pass a LOW, while if the pulse was in B, it will propagate a HIGH. The transmission gate is controlled by the XOR of the two shift register outputs, so that it is turned on when there is a pulse in either register. The output of register A is inverted, and the result is combined with the output of register B with an AND gate.

A SRAM cell 62 (which is inverting) then maintains its output once the transmission gate returns to a high-impedance (off) state, so that the output switches to low each time one shift register pulse is received and switches to high each time the other shift register pulse is received.

Figure 7:
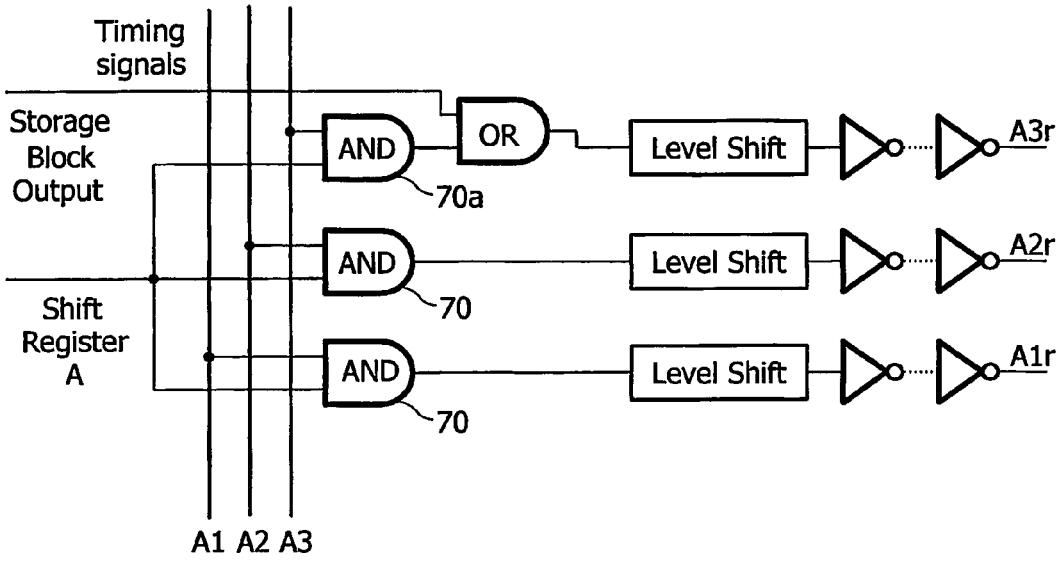
FIG. 7 shows the full logic function based on the logic elements of FIG. 6.

FIG. 7 shows how the variable duration emission signal is combined with the other control signals, and the address (A3*r*, A2*r*, A1*r*) signals for the row are generated.

Template timing signals A1, A2 and A3 are used, and these are signal which repeat themselves for each row. This will become apparent further below when a timing diagram is shown. To derive control signals occurring only during the row address period, these template signals are combined with AND gates 70 with a signal from the shift register A, which is a high pulse for the duration of that row address period. This provides the row address signals A1*r* and A2*r* for the row, using the references from FIG. 3.

The row control signal A3*r* is for the interrupting transistor 28, and thus has an on pulse of variable duration. This on pulse has a duration which is typically a number of row address period durations, and thus varies not within the line time, but within the frame time.

The output of the circuit of FIG. 6 is combined with an OR gate with the output of the AND gate 70*a*, so that the resulting signal has the required profile during the address period for the normal pixel programming (derived from the template signal A3) but then also has an on pulse of variable duration for scrolling control.

In a second embodiment, the same logic is used as for the first embodiment. However, the pulse propagating in one shift register A has the duration corresponding to the line time of the display, and the pulse propagating in the other shift register B has a duration for controlling the display element illumination period. For example, the pulse in shift register B can be a number of joined consecutive pulses.

Figure 8:
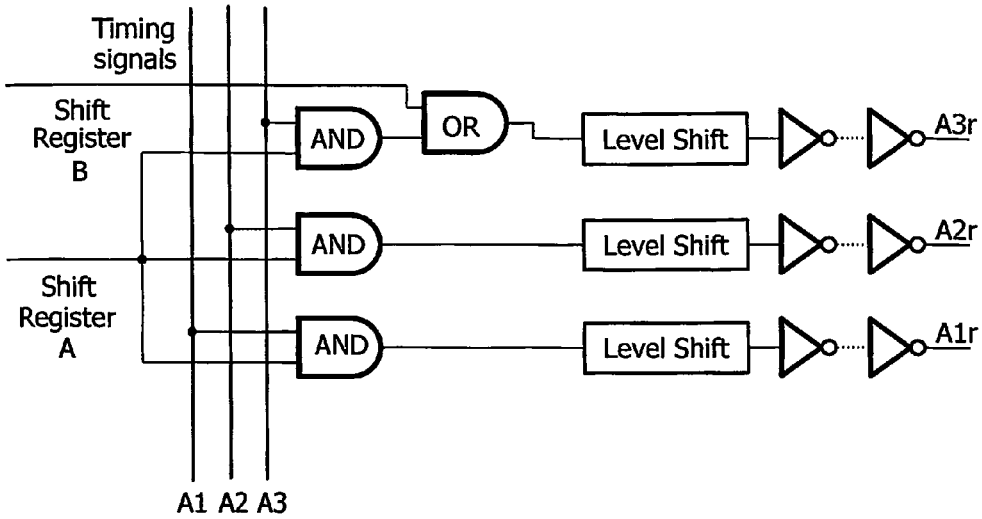
FIG. 8 shows a second implementation of the logic elements used in the circuit of FIG. 5.
Figure 9:
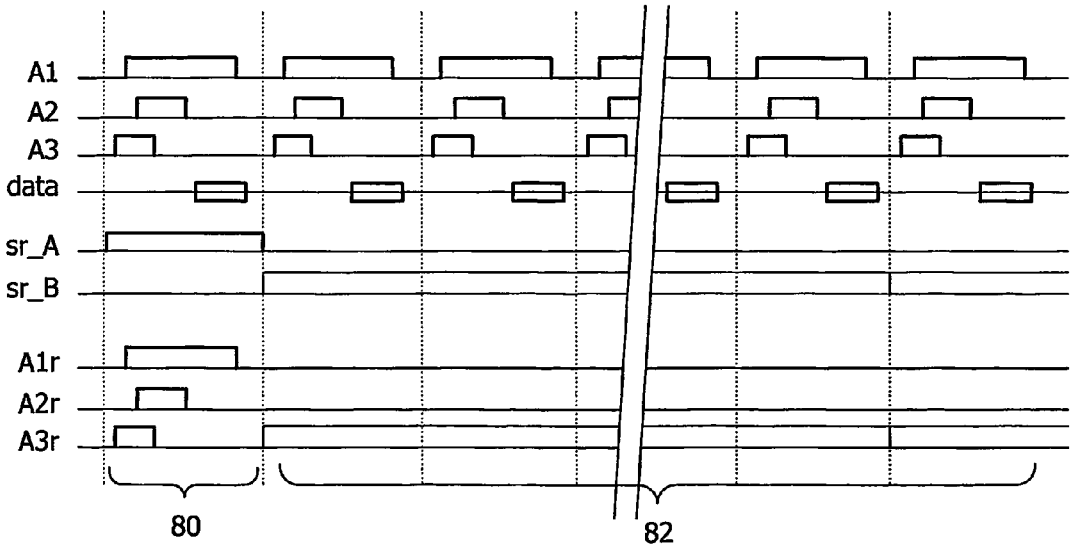
FIG. 9 shows a timing diagram for the operation of the circuit of FIG. 8.

The circuit is shown in FIG. 8 and the timing diagram is shown in FIG. 9. The need for the storage block of FIG. 6 is eliminated, and the pulse of variable duration is taken directly from shift register B.

This simplifies the circuitry and improves reliability, as the latch circuits are no longer required.

In FIG. 9, A1, A2 and A3 represent the global template timing inputs, and as mentioned above, these repeat with a frequency of the line time. sr_A and sr_B represent the shift-register outputs for one particular line. sr_A has a duration of one line time, whereas sr_B has a variable duration of a number of line times, starting after the end of the signal sr_A.

A1*r*, A2*r* and A3*r* represent the resulting address signals obtained for that particular line for application to the pixel as shown in FIG. 3.

The timing diagram shows how the register A is used to extract the timing for the control signals for the addressing period 80, whereas the register B is used to control the on-time during the remainder 82 of the frame period.

The scheme shown in FIGS. 8 and 9 can be further simplified by combining the function of the two shift registers into one. This can be achieved by passing a long pulse through the single shift register and using an extra AND gate for each row to generate the addressing only on the leading edge of that pulse.

Figure 10:
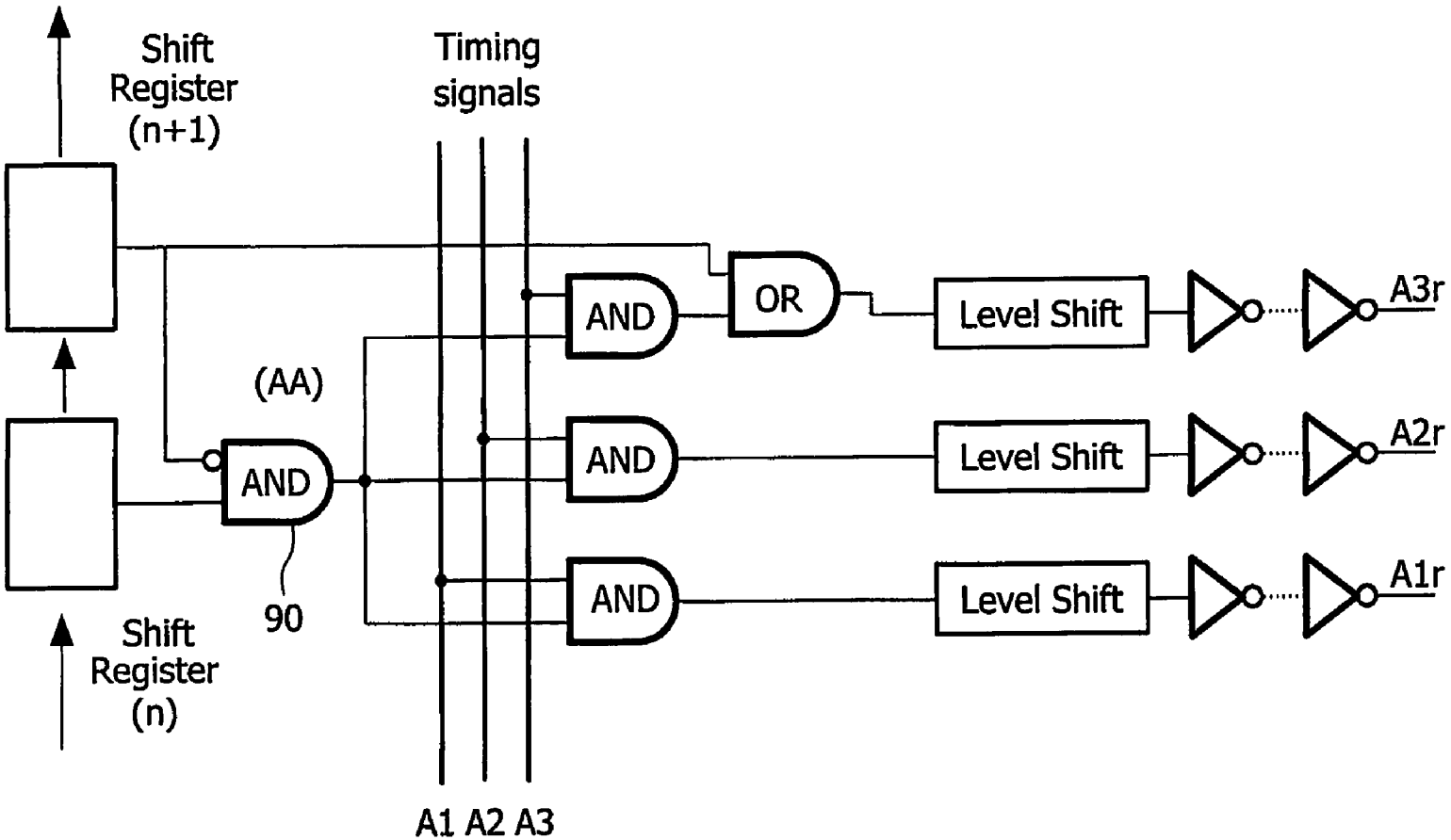
FIG. 10 shows a third implementation of the logic elements used in the circuit of FIG. 5, and requiring only one shift register chain.

FIG. 10 shows this simplified row driver architecture. The additional and gate combines one long pulse for the row being addressed (n+1) with the long pulse for the preceding row (n) in order to derive a pulse having a duration of the line time and which functions as the output of shift register A in FIGS. 8 and 9. The output of the shift register for row (n+1) corresponds to the output of shift register B in FIGS. 8 and 9. Thus, the circuit of FIG. 10 generates the same outputs as shown in FIG. 9, but using a single shift register chain. The circuits otherwise function in the same way.

The long pulse can be obtained by feeding a series of pulses into consecutive 'buckets' in the shift register.

The row driver architecture can be used to generate a range of different scrolling schemes.

In the basic scrolling arrangement, there is a horizontal band in which light is generated, while the rest of the display is off. This band moves from top to bottom. At the bottom, it splits up in a part still visible at the bottom, and a new growing part at the top. So at any time, a fixed number adjacent lines are generating light. The speed is such that there is a repetition rate equal to the field rate of the display.

It is, however, also possible to move the band from bottom to top, or use a vertical band of light that moves from left to right or right to left.

The height of the band of light can be varied by changing the vertical distance between the line that is programmed with new video contents (addressed line) and the line that is reprogrammed to be black (erased line). This distance of course relates to the on-period of the display rows. Changing this distance and therefore the duty cycle of the light generation is therefore very simple, by controlling the shift registers, which are common to all rows of pixels. This opens the possibility to change the duty cycle dynamically, for example based on the video contents.

Another possibility is to make the duty cycle dependent on the vertical position, so as to decrease the light output at the top of the bottom of the screen. This is common practice in CRT systems without this being visible or annoying to the end user. The benefit is reduction in power consumption. This would require modification to the drive scheme shown above, as it provides a fixed pulse duration for all rows.

Compared to the 'address & flash' addressing scheme, the scrolling bar scheme described above will exhibit less field flicker, as there is always a part of the display that is generating light. This means that the scrolling bar display can operate at a lower frame rate than the address & flash without noticeable field flicker.

From an engineering point of view, the scrolling bar scheme has several advantages. The power consumption of the screen is fairly constant. For a uniform image, it is constant. For images with video contents, it varies with the average brightness of the image in the band of light. High peak currents that occur in other addressing schemes (e.g. address & flash) are not present. The high currents are a great challenge especially for large displays.

Compared to the address and flash addressing scheme, the scrolling bar scheme has the advantage of a fixed line address time, regardless of the duty cycle, making the display more flexible.

A line can be erased by manipulating the address signals, and this erasing operation can be done in parallel with the addressing of another line. In particular, the video information on the column lines are not relevant for the erased line.

In FIG. 10, the positive edge of the single long pulse is detected by comparing the outputs of the shift registers n and n+1. The AND gate 90 combines the state of the two shift registers, and the output is 1 when the positive edge of the pulse is detected, causing the address lines A1*r* to A3*r* to be active.

An erase signal can be generated in a similar way by detecting the falling edge of the pulse and, on detection, generating an erase signal sequence on the address lines A1*r*-A3*r*. The erase operation can be carried out without reference to the signal on the column conductor, so that one row can be erased simultaneously with the addressing of another row using data on the column conductor. Thus, it is possible to generate separate control signals for the start and end of the illumination period, although it is preferred to use a single variable duration signal to generate the A3*r* signal as in the above embodiments.

Other modifications will be apparent to those skilled in the art.

The invention claimed is:

1. An active matrix electroluminescent display device comprising an array of display pixels arranged in rows and columns, each pixel comprising:

an electroluminescent (EL) display element;

a drive transistor for driving a current through the display element;

means for directly interrupting the drive of current through the display element via a direct interrupt signal, said direct interruption means being provided in series with the electroluminescent display element; and row driver circuitry for generating control voltages to be applied to the pixels in each row in sequence including a drive voltage as input to the interrupting means, wherein the row driver circuitry comprises a shift register arrangement and logic arrangement for generating the drive voltage for the interrupting means, the drive voltage for the interrupting means including a long emission time pulse for controlling the output of the display element, the long emission time pulse having a duration which can be varied up to substantially the full field period less the address period, and wherein the timing of the end of the long emission time pulse corresponds to the timing of the direct interrupt signal generated by the interrupting means for controlling the display element illumination time, wherein the signal or signals propagated through the shift register arrangement control the pulse duration.

2. A device as claimed in claim 1, wherein the shift register arrangement and logic arrangement comprises first and second shift register devices, each having a pulse propagating through them, and logic means for deriving a signal having a pulse with duration derived from the difference in timing of the pulses propagating through the first and second shift register devices.

3. A device as claimed in claim 1, wherein the pulse propagating in each shift register device has a duration corresponding the line time of the display.

4. A device as claimed in claim 1, wherein the logic means comprises a transmission gate which transmits a low pulse in response to a pulse on one of the shift register devices and transmits a high pulse in response to a pulse on the other one of the shift register devices.

5. A device as claimed in claim 4, wherein the logic means further comprises a memory cell for maintaining a constant output between pulses received from the transmission gate.

6. A device as claimed in claim 1, wherein the shift register arrangement and logic arrangement comprises first and second shift register devices, each having a pulse propagating through them, and logic means for deriving a signal having a pulse with duration derived from the duration of the pulse in one of the first and second shift register devices.

7. A device as claimed in claim 6, wherein the pulse propagating in one shift register device has a duration corresponding to the line time of the display and the pulse propagating in the other shift register device has a duration for controlling the display element illumination period.

8. A device as claimed in claim 1, wherein the shift register arrangement and logic arrangement comprises a shift register device, having a pulse propagating through it having a duration dependent on the desired illumination time of the display element, and logic means for deriving from the shift register device a pulse having a duration corresponding to the line time of the display.

9. A device as claimed in claim 8, wherein the logic means for deriving from the shift register device a pulse having a duration corresponding to the line time of the display comprises a combination element for combining the pulse at the output of one shift register element (n) for one row with the pulse at the output of another shift register element (n+1) for an adjacent row.

10. A device as claimed in claim 1, wherein each pixel comprises drive transistor threshold compensation circuitry.

11. A device as claimed in claim 10, wherein the drive transistor, the electroluminescent display element and means for interrupting the drive of current through the display element are connected in series between a power supply line and a common potential line.

12. A device as claimed in claim 11, wherein the means for interrupting comprises a transistor.

13. An active matrix electroluminescent display device comprising an array of display pixels arranged in rows and columns, each pixel comprising:

an electroluminescent (EL) display element;

a drive transistor for driving a current through the display element;

means for interrupting the drive of current through the display element; and row driver circuitry for generating control voltages to be applied to the pixels in each row in sequence including a drive voltage for the interrupting means, wherein the row driver circuitry comprises a shift register arrangement and logic arrangement for generating the drive voltage for the interrupting means, the drive voltage for the interrupting means including a pulse having a duration which can be varied up to substantially the full field period less the address period, wherein the signal or signals propagated through the shift register arrangement controls the pulse duration, wherein a first pulse from the shift register arrangement and logic arrangement is combined with a first template control signal or signals (A1, A2) to provide a first control signal or signals (A1r,A2r) for the addressing of the pixel, and a second pulse from the shift register arrangement and logic arrangement is combined with a second template control signal (A3) to provide the drive voltage (A3r) for the interrupting means both during the addressing of the pixel and during subsequent driving of the pixel.

14. A device as claimed in claim 13, wherein the first pulse has duration equal to the line time.

15. A device as claimed in claim 13, wherein the second pulse has duration selected to control the display element illumination time.

16. An active matrix electroluminescent display device comprising an array of display pixels arranged in rows and columns, each pixel comprising:

an electroluminescent (EL) display element;

a drive transistor for driving a current through the display element; means for interrupting the drive of current through the display element; and row driver circuitry for generating control voltages to be applied to the pixels in each row in sequence including a drive voltage for the interrupting means, wherein the row driver circuitry comprises a shift register arrangement and logic arrangement for generating the drive voltage for the interrupting means, the drive voltage for the interrupting means including a pulse having a duration which can be varied up to substantially the full field period less the address period, wherein the signal or signals propagated through the shift register arrangement controls the pulse duration, wherein each pixel comprises drive transistor threshold compensation circuitry, wherein the drive transistor threshold compensation circuitry comprises first and second capacitors connected in series between the gate and source of the drive transistor, a data input to the pixel being provided to the junction between the first and second capacitors thereby to charge the first capacitor to a voltage derived from the pixel data voltage, and a voltage derived from the drive transistor threshold voltage being stored on the second capacitor.

17. A method of driving an active matrix electroluminescent display device comprising an array of display pixels arranged in rows and columns, in which each pixel comprises an electroluminescent (EL) display element, a drive transistor for driving a current through the display element and means for directly interrupting the drive of current through the display element provided in series with the electroluminescent display element, the method comprising:

propagating a pulse or pulses through a shift register arrangement;

using a pulse from the shift register arrangement to allow pixel addressing control voltages to be applied to the pixels of a row during an addressing period;

using the shift register pulse or pulses to derive a drive voltage as input to the interrupting means including a long emission time pulse for controlling the output of the display element, the long emission time pulse having a duration which can be varied up to substantially the full field period less the addressing period; and applying the drive voltage for the interrupting means to the interrupting means after the pixel addressing period, the timing of the end of the pulse corresponding to the timing of an interrupt by the means for interrupting, wherein the shift register arrangement and logic arrangement comprises first and second shift register devices, each having a pulse propagating through them, and logic means for deriving a signal having a long emission time pulse derived from the difference in timing of the pulses propagating through the first and second shift register devices, and wherein said derived signal is synchronized to the frame time.

* * * * *